US006878080B2

(12) United States Patent
Chang

(10) Patent No.: US 6,878,080 B2
(45) Date of Patent: Apr. 12, 2005

(54) COMBINATION BAT FOR BASEBALL

(76) Inventor: Jung-Shih Chang, No. 32, Lane 25, Li Min Street., Ta Li City, Taichung Hsien (TW)

( * ) Notice: Subject to any disclaimer, the term of this patent is extended or adjusted under 35 U.S.C. 154(b) by 0 days.

(21) Appl. No.: 10/704,819

(22) Filed: Nov. 12, 2003

(65) Prior Publication Data

US 2005/0059515 A1 Mar. 17, 2005

(30) Foreign Application Priority Data

Sep. 17, 2003 (CN) ..... 03158970 A

(51) Int. Cl.[7] ..... A63B 59/06
(52) U.S. Cl. ..... 473/564; 973/567
(58) Field of Search ..... 473/564–568, 473/519, 520, 457

(56) References Cited

U.S. PATENT DOCUMENTS 377,686 A * 2/1888 Moose ..... 473/564
727,359 A * 5/1903 Held ..... 473/564
795,815 A * 8/1905 Burrows ..... 473/564
1,063,563 A * 6/1913 May ..... 473/564
1,665,195 A * 4/1928 Cohn ..... 473/520
2,195,681 A * 4/1940 Robarge ..... 473/564
2,379,006 A * 6/1945 Johnson ..... 473/568
3,377,066 A * 4/1968 Trowbridge ..... 473/564
3,877,698 A * 4/1975 Volpe ..... 473/520
4,572,508 A * 2/1986 You ..... 473/520
4,714,251 A * 12/1987 Cook ..... 473/564
4,844,460 A * 7/1989 Mitchell et al. ..... 473/564
5,165,686 A * 11/1992 Morgan ..... 473/564
5,277,421 A * 1/1994 Rewolinski ..... 473/457
6,113,508 A * 9/2000 Locarno et al. ..... 473/516
6,139,451 A * 10/2000 Hillerich, III et al. ..... 473/564
6,692,386 B2 * 2/2004 Brundage ..... 473/457
2004/0029660 A1 * 2/2004 Chen et al. ..... 473/564

* cited by examiner

*Primary Examiner*—Mark S. Graham
(74) *Attorney, Agent, or Firm*—Browdy and Neimark, P.L.L.C.

(57) ABSTRACT

A combination bat includes a wood body and a tubular core. The wood body has a handle, a barrel extending from one end of the handle, and an axial hole. The tubular core is made of fiber reinforced plastic materials and axially received inside the axial hole of the wood body. A shock-absorbing member is inserted inside the tubular core.

15 Claims, 4 Drawing Sheets

COMBINATION BAT FOR BASEBALL

BACKGROUND OF THE INVENTION

1. Field of the Invention

The present invention relates to bats for baseball and, more particularly, to a combination bat, which comprises a hollow wood body and at least one tubular core made of fiber reinforced plastic materials and axially fitted into the inside of the hollow wood bat body.

2. Description of the Related Art

Wood bats are most popularly used because they are the cheapest ones. However, wood bats have numerous drawbacks, such as heavy weight and bad equilibrium. In other words, the center of gravity is biased to the side of the barrel end. The center of gravity of a wood bat is at about 11 inches from the barrel end, however the ideal center of gravity should be at the area within 14~14.5 inches from the barrel end. Due to the aforesaid drawbacks, it requires much effort to hit the ball with the bat, and the bat cannot drive the ball to a long distance. Further, a wood bat is weak and easy to break, and produces severe shocks when hitting the ball.

In comparison to wood bats, an aluminum bat is relatively lighter in weight, and has an ideal equilibrium. Therefore, the performance of an aluminum bat is superior to conventional wood bats, and an aluminum bat is more durable than conventional wood bats. Further, the price of aluminum bats is reasonable. However, an aluminum bat produces shocks, noises and dents at barrel when hitting the ball.

The recently developed bats made of fiber reinforced plastic (FRP) material have the ideal counterweight and equilibrium and high performance in hitting. Further, a FRP bat has a strong structural strength, and does not break easily. However, the problem is that the FRP bat is so expensive that can not be popular used.

SUMMARY OF THE INVENTION

It is one object of the present invention to provide a combination bat, which has a light weight, good equilibrium, and high structural strength for a good performance.

It is another object of the present invention to provide a combination bat, which produces less shock when hitting the ball.

It is still another object of the present invention to provide a combination bat, which has its center of gravity adjustable.

It is still another object of the present invention to provide a combination bat, which has the surface well protected against damage.

To achieve these and other objects of the present invention, the combination bat comprises a wood body having a handle and a barrel extending from one end of the handle. At least one tubular core made of fiber reinforced plastic materials is axially received inside the wood body. The combination bat may further comprise at least one shock-absorbing member installed in the tubular core(s) to lessen shocks when hitting the ball or one weighting member installed in the tubular core to adjust the center of gravity of the bat. The periphery of the barrel of the combination bat may be covered with a reinforced layer made of FRP materials to improve the surface strength.

BRIEF DESCRIPTION OF THE DRAWINGS

These and other objects of the invention will become more clear upon a through study of the following description of the best mode for carrying out the invention, particularly when reviewed in conjunction with the drawings, wherein.

DETAILED DESCRIPTION OF THE INVENTION

Figure 1:
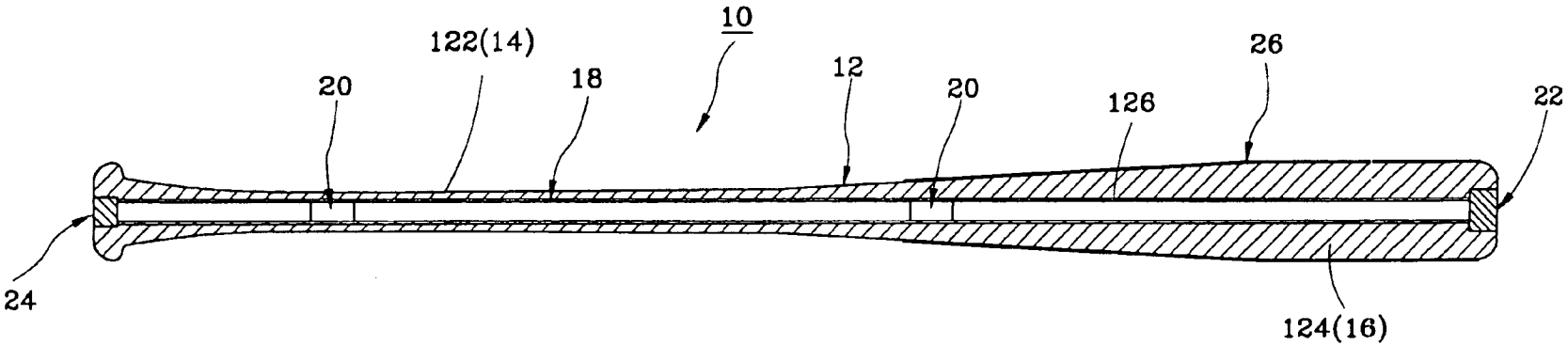
FIG. 1 is a longitudinal sectional view of a combination bat constructed according to the first embodiment of the present invention.

Referring to FIG. 1, a combination bat, referenced by 10, in accordance with the first embodiment of the present invention is shown comprising a wood body 12, a core 18, two shock-absorbing member 20, a front end plug 22, a rear end plug 24, and a cover layer 26.

The wood body 12 having the shape of a conventional bat for baseball includes a rear part 122 forming a handle 14, a front part 124 forming a barrel 16. The body 12 has an axial hole 126 axially extended through the two ends thereof.

The core 18 is a tubular member made of fiber reinforced plastic materials, for example, carbon fiber reinforced epoxy resin, having an outer diameter fitting the diameter of the axial hole 126 to be tightly received in the axial hole 126.

The two shock-absorbing members 20 are cylindrical members respectively made of shock-absorbing materials such as foamed plastic, cloth or cork and tightly inserted into the inside of the core 18 at selected locations. The shock-absorbing members 20 can be made having a certain weight for adjusting the center of gravity of the bat 10. The front end plug 22 is plugged into the front end of the axial hole 126. The rear end 24 is plugged into the rear end of the axial hole 126.

The cover layer 26 is made of fiber reinforced plastic materials, for example, carbon fiber reinforced epoxy resin and covered on the surface of the barrel 16. According to this embodiment, the cover layer 26 covers the whole surface of the front part 124.

Figure 2:
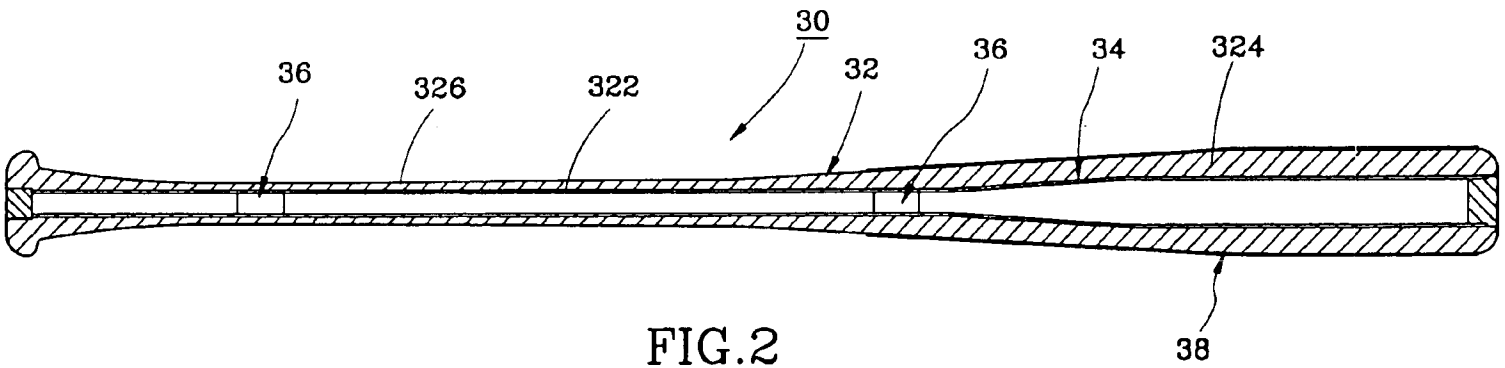
FIG. 2 is a longitudinal sectional view of a combination bat constructed according to the second embodiment of the present invention.

In production, the bat can be variously embodied. FIG. 2 shows a combination bat 30 constructed according to the second embodiment of the present invention. According to this embodiment, the wood body 32 has an axial hole 322 axially extended through the two ends. The diameter of the axial hole 322 is changed subject to the outer diameter of the body 32, i.e., the diameter of the front portion of the axial hole 322 in the barrel 324 is relatively larger than the diameter of the rear portion of the axial hole 322 in the handle 326, and the diameter of the axial hole 322 in the middle area between the handle 326 and the barrel 324 is gradually increased in direction from the handle 326 toward the barrel 324.

An integrated tubular core 34 is received in the axial hole 322. Two shock-absorbing members 36 (or two weights, or a weight at the front side and a shock-absorbing member at the rear side, or other combination) are inserted into the inside of the core 34. A cover layer 38 is made of fiber reinforced plastic materials, for example, carbon fiber reinforced epoxy resin and covered on the whole surface of the barrel 324.

Figure 3:
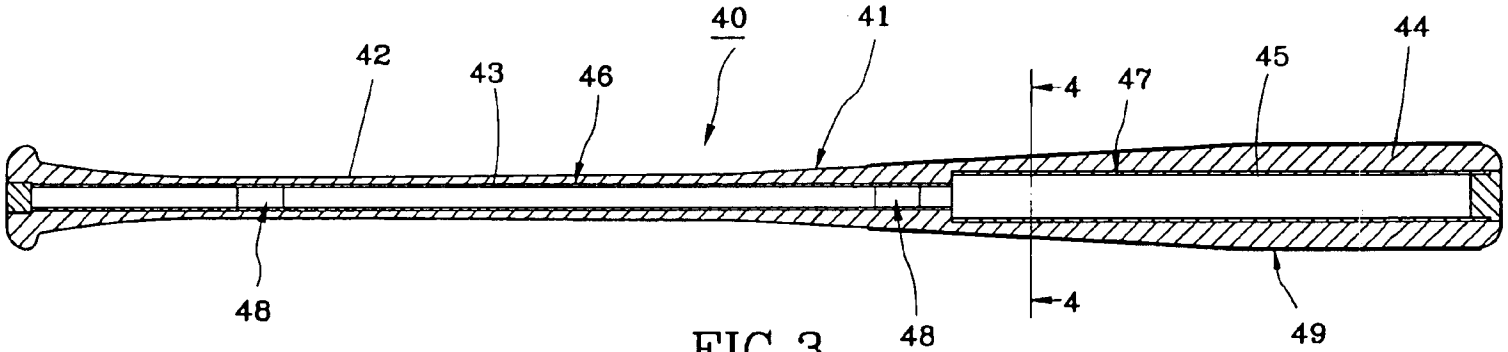
FIG. 3 is a longitudinal sectional view of a combination bat constructed according to the third embodiment of the present invention.
Figure 4:
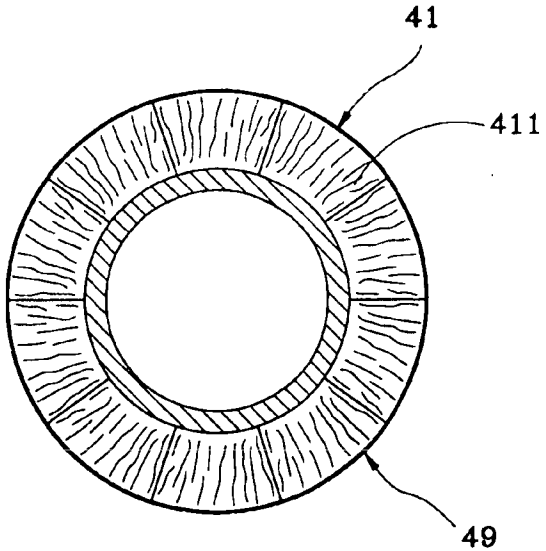
FIG. 4 is a sectional view taken along line 4—4 of FIG. 3.

FIGS. 3 and 4 shows a combination bat 40 constructed according to the third embodiment of the present invention. According to this embodiment, the whole wood body 41 is made of sane material, having a first axial hole 43 with a first diameter in the handle 42 and a second axial hole 45 with a second diameter in the barrel 44. The second diameter of the second axial hole 45 is relatively larger than the first diameter of the first axial hole 43. A first tubular core 46 and a second tubular core 47 are respectively received in the first axial hole 43 and the second axial hole 45.

The body 41 can be formed of a plurality of transversely arched wood blocks 411 abutted against and adhered to one another. According to this embodiment, the body 41 is formed of ten wood blocks 411 symmetrically arranged together (as shown in FIG. 4). The number of the wood blocks 411, of course, can be 2, 4, 8, etc. The wood blocks 411 may be not symmetrical. The grains of each wood block 411 substantially extend in the radial direction of the bat body 41.

Two weights 48 are inserted into the first tubular core 46, and adapted to adjust the center of gravity of the combination bat 40. The weights 48 can be made of shock-absorbing materials to lessen shocks upon hitting a pitched ball of the combination bat 40 against the ball. Preferably, the first tubular core 46 is internally threaded, and the weights 48 are externally threaded for threading into the first tubular core 46. By means of turning the weights 48 forwards or backwards in the first tubular core 46, the center of gravity of the bat 40 is relatively adjusted. Similarly, the surface of the barrel 44 is covered with a cover layer 49.

Figure 5:
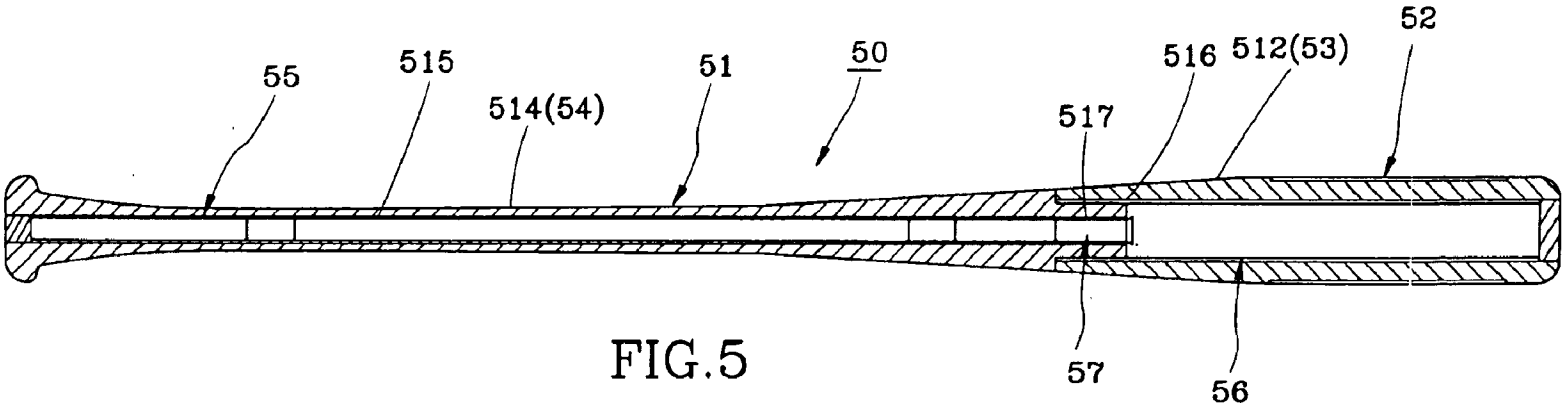
FIG. 5 is a longitudinal sectional view of a combination bat constructed according to the fourth embodiment of the present invention.

FIG. 5 shows a combination bat 50 constructed according to the fourth embodiment of the present invention. According to this embodiment, the bat 50 is similar to the bat 40 of the third embodiment. The differences between the two bats are that the wood body 51 of the bat 50 is jointed by two independent sections and only a portion of the surface of the barrel is covered by the cover layer 52.

Further speaking, the wood body 51 has a front section 512 forming a barrel 53 and a rear section 514 forming a handle 54. The rear section 514 has a first axial hole 515 of a first diameter. The front section 512 has a second axial hole 516 of a second diameter. The second diameter of the second axial hole 516 is relatively larger than the first diameter of the first axial hole 515. A first tubular core 55 and a second tubular core 56 are respectively received in the first axial hole 515 and the second axial hole 516.

The rear section 514 has a front end terminating in a neck 517. The neck 517 is fitted to insert into the rear end of the inside of the second tubular core 56. The front section 512 and the rear section 514 may be made from different wood materials, for example, the material of the rear section 514 is maple and the material of the front section 512 is walnut. A central plug 57 is plugged into the front end of the inside of the first tubular core 55.

Figure 6:
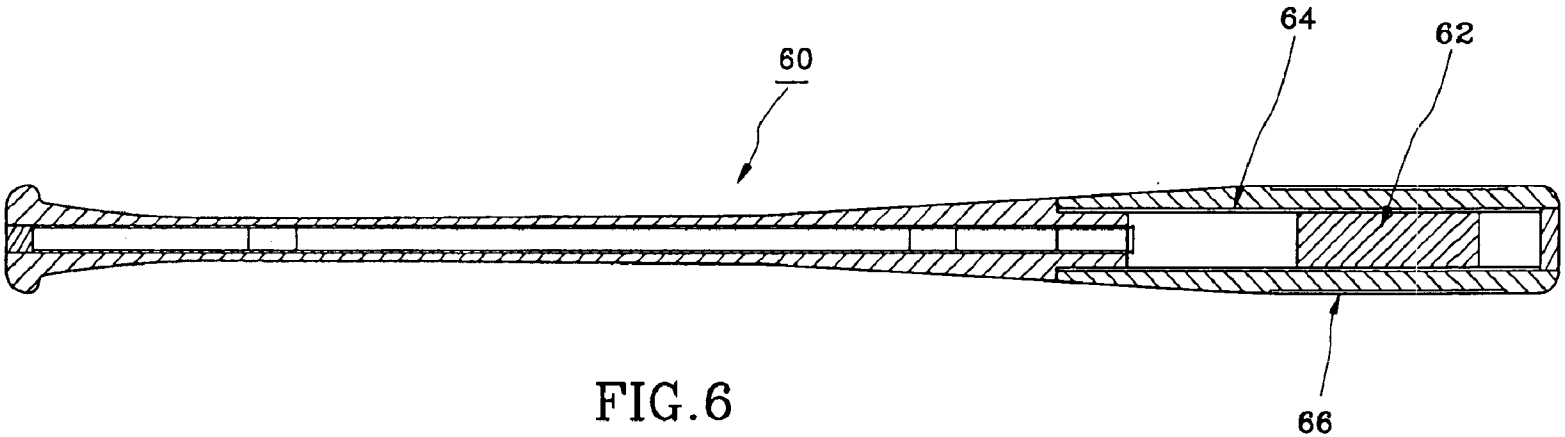
FIG. 6 is a longitudinal sectional view of a combination bat constructed according to the fifth embodiment of the present invention.

FIG. 6 shows a combination bat 60 constructed according to the fifth embodiment of the present invention. According to this embodiment, the bat 60 is similar to the bat 50 of the fourth embodiment. The only difference between the two bats is that the bat 60 includes a reinforcing member 62 made of wood or metal which is inserted into the inside of the second tubular core 64 and located in a position corresponding the cover layer 66.

Figure 7:
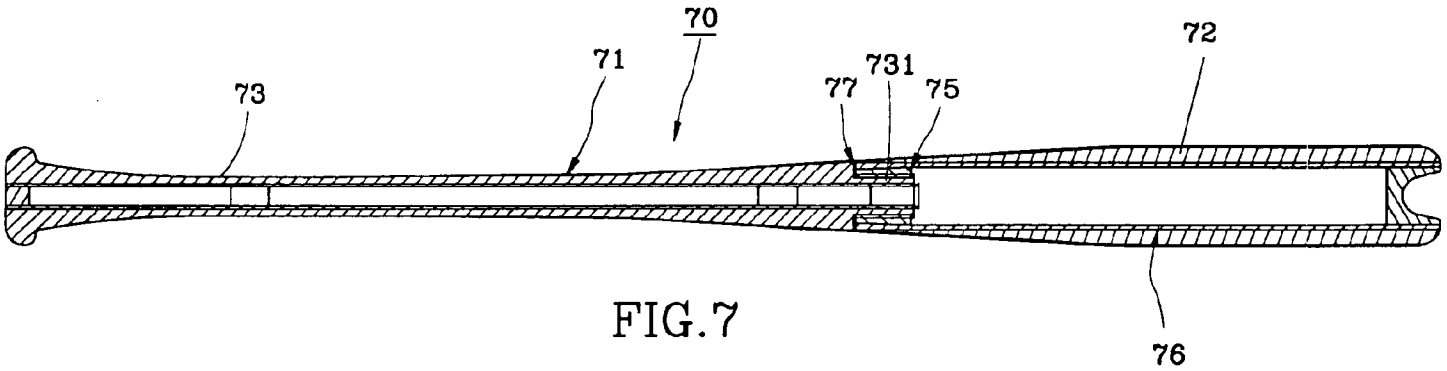
FIG. 7 is a longitudinal sectional view of a combination bat constructed according to the sixth embodiment of the present invention.
Figure 8:
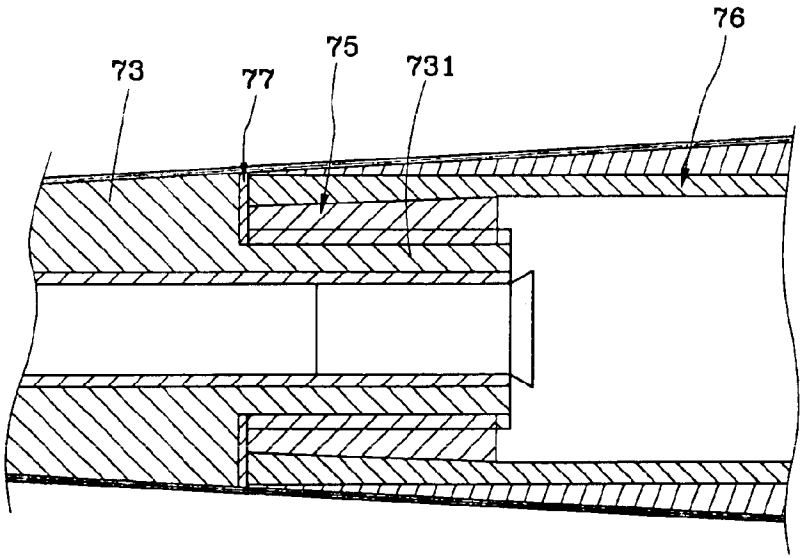
FIG. 8 is an enlarged view of the connection area between the front part and rear part of the combination bat according to the sixth embodiment of the present invention.

FIGS. 7 and 8 shows a combination bat 70 constructed according to the sixth embodiment of the present invention. According to this embodiment, the bat 70 is similar to the bat 50 but the jointing way of the bat body is different from the bat 50.

The bat 70 has a wood body 71 having a front section 72 and a rear section 73. The rear section 73 has a front end terminating in a threaded neck 731. A nut 75 is fixedly mounted to the rear end of the inside of the second tubular core 76 (during fabrication of the second tubular core 76, the nut 75 is embedded to the rear end of the inside of the second core 76).

The front section 72 is jointed to the rear section 73 by means of threading the nut 75 onto the threaded neck 731. An elastic ring 77 made of rubber is sleeved onto the threaded neck 731 before threading.

The combination bats mentioned above have numerous advantages as follows:

1. Because the wood bat body is a tubular hollow member and the cores and the shock-absorbing blocks have a relatively lower specific gravity than wood material, the total weight of the combination bat is relatively lighter than conventional wood bats.

2. The center of gravity of the bat can be positioned within the area between 14~14.5 inches distanced from the barrel end thereof.

3. Because the axial center of the wood bat body is filled with the FRP cores, the combination bat would not be broken or deformed easily. Further, because the barrel is peripherally covered with the FRP cover layer, the surface of the barrel is well protected against damage.

4. The shock-absorbing blocks in the bat body can absorb shocks upon hitting a pitched ball, preventing sport injury to the user.

5. The combination bat does not cause noises like an aluminum bag when hitting the ball.

6. The combination bat has all advantages of a FRP bat; however the manufacturing cost of the combination bat is relatively lower than a FRP bat. Further, because the bat body is jointed by a rear section and a front section respectively made of different wood materials, the center of gravity of the combination bat is adjustable, and the manufacturing cost of the combination bat can be greatly reduced by using high quality (expensive) wood material only at specific locations.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A baseball bat comprising a wood body having a handle, a barrel extending from one end of said handle, and an axial hole, at least one tubular core made of fiber reinforced plastic materials and tightly received in said axial hole of said wood body, and wherein said wood body includes a front section forming said barrel, a rear section forming said handle and fixed to an open end of said front section, a first axial hole axially extending through said rear section, and a second axial hole axially extending through said front section, said at least one tubular core includes a first tubular core received in said first axial hole, and a second tubular core received in said second axial hole.

2. The baseball bat as claimed in claim 1, further comprising at least one shock-absorbing member respectively inserted inside said at least one tubular core.

3. The baseball bat as claimed in claim 1, further comprising at least one weight respectively inserted inside said at least one tubular core.

4. The baseball bat as claimed in claim 3, wherein said at least one tubular core has an axially extended inner thread, said at least one weight has an outer thread threading into the inner thread of said at least one tubular core.

5. The baseball bat as claimed in claim 1, further comprising a cover layer made of fiber reinforced plastic materials and covered on the surface of said barrel.

6. The baseball bat as claimed in claim 1, wherein said first axial hole axially extends through said handle and said second axial hole axially which extends through said barrel is in line with said first axial hole, said second axial hole having a diameter relatively larger than said first axial hole.

7. The baseball bat as claimed in claim 1, wherein said front section and said rear section being respectively made of different wood materials.

8. The baseball bat as claimed in claim 1, further comprising a cover layer made of fiber reinforced plastic materials and covering on the surface of said front section.

9. The baseball bat as claimed in claim 1, wherein said rear section has a front end terminating in a neck fitted to be inserted into the rear end of the inside of said second tubular core.

10. The baseball bat as claimed in claim 1, wherein said rear section has a front end terminating in a threaded neck, said front section has a rear end fixedly mounted with a nut threaded onto said threaded neck.

11. The baseball bat as claimed in claim 9, further comprising an elastic ring sleeved on said neck and sandwiched in between said front section and said rear section.

12. The baseball bat as claimed in claim 10, further comprising an elastic ring sleeved on said threaded neck and sandwiched in between said front section and said rear section.

13. The baseball bat as claimed in claim 1, wherein said first axial hole axially extends through a front end of said rear section, said first tubular core has a front end plugged with a plug.

14. The baseball bat as claimed in claim 1, wherein said rear section and said front section are respectively formed of a plurality of wood blocks abutted against one another around said first axial hole and said second axial hole.

15. The baseball bat as claimed in claim 14, wherein the grains of each said wood block substantially extend in the radial direction of the body.

* * * * *